US006752203B2

(12) United States Patent
Kurita

(10) Patent No.: US 6,752,203 B2
(45) Date of Patent: Jun. 22, 2004

(54) COOLING AND HEATING SYSTEM AND AIR CIRCULATION PANEL

(75) Inventor: Yasuo Kurita, Toyohashi (JP)

(73) Assignee: Kurita Kogyo Co., Ltd., Toyohashi (JP)

( * ) Notice: Subject to any disclaimer, the term of this patent is extended or adjusted under 35 U.S.C. 154(b) by 308 days.

(21) Appl. No.: 09/894,156

(22) Filed: Jun. 27, 2001

(65) Prior Publication Data

US 2002/0000311 A1 Jan. 3, 2002

(30) Foreign Application Priority Data

Jun. 28, 2000 (JP) ..... 2000-194324

(51) Int. Cl.[7] ..... F28F 3/12

(52) U.S. Cl. ..... 165/169; 165/168; 165/170; 165/46; 165/56; 165/171

(58) Field of Search ..... 165/49, 56, 168, 165/170, 171, 908; 237/69

(56) References Cited

U.S. PATENT DOCUMENTS

| | | | | | |
|---|---|---|---|---|---|
| 3,379,031 | A | * | 4/1968 | Lewis, Jr. | 62/235 |
| 4,394,817 | A | * | 7/1983 | Remillard | 62/235 |
| 4,416,259 | A | | 11/1983 | Skogstrom et al. | |
| 4,541,479 | A | * | 9/1985 | Bergeron, Jr. | 165/45 |
| 4,703,597 | A | * | 11/1987 | Eggemar | 52/220 |
| 4,782,889 | A | * | 11/1988 | Bourne | 165/56 |
| 4,979,373 | A | * | 12/1990 | Huppee | 62/235 |
| 5,027,613 | A | * | 7/1991 | Pare | 62/235 |
| 5,042,569 | A | * | 8/1991 | Siegmund | 165/56 |
| 5,097,893 | A | * | 3/1992 | Trimble | 165/46 |
| 5,251,689 | A | * | 10/1993 | Hakim-Elahi | 165/46 |
| 5,327,737 | A | * | 7/1994 | Eggemar | 62/66 |
| 5,467,815 | A | * | 11/1995 | Haumann et al. | 165/109.1 |
| 5,595,171 | A | * | 1/1997 | Makin | 126/271.1 |
| 6,021,646 | A | * | 2/2000 | Burley et al. | 62/235 |
| 6,152,377 | A | * | 11/2000 | Fiedrich | 237/69 |

FOREIGN PATENT DOCUMENTS

| | | | | |
|---|---|---|---|---|
| DE | 831 596 | | 2/1952 | |
| DE | 1 579 906 | | 9/1970 | |
| EP | 0 340 825 | * | 11/1989 | F24D/3/14 |
| JP | 56144353 | | 11/1981 | |
| JP | 63116030 | | 5/1988 | |
| JP | 363207923 A | * | 8/1988 | F24D/3/16 |
| JP | 401046525 A | * | 2/1989 | F24F/1/00 |
| JP | 401247929 A | * | 10/1989 | F24F/1/00 |
| JP | 402161223 A | * | 6/1990 | F24D/3/16 |
| JP | 402230034 A | * | 9/1990 | F24F/3/044 |
| JP | 402285135 A | * | 11/1990 | E04B/5/48 |
| JP | 2001-165476 | | 6/2001 | |
| JP | 2001304594 | | 10/2001 | |
| JP | 02002054867 A | * | 2/2002 | F25D/13/00 |

OTHER PUBLICATIONS

Patent Abstract of Japan for JP 2001–165476 published on Jun. 22, 2001.

* cited by examiner

*Primary Examiner*—Henry Bennett
*Assistant Examiner*—Nihir Patel
(74) *Attorney, Agent, or Firm*—Darby & Darby

(57) ABSTRACT

A thermal control system includes an air colliding chamber bounded by at least a conducting board and an insulating panel. An air jet pipe and an air jet suction pipe extend into the air colliding chamber. Thermally adjusted air is urged into each air jet pipe, and out at least one air jet hole, into the air colliding chamber. In the air colliding chamber, air vortices repeatedly contact the conducting board and thermal transfer occurs. Return air is urged into each air suction pipe through at least one jet suction hole for return and thermal adjustment.

10 Claims, 6 Drawing Sheets

COOLING AND HEATING SYSTEM AND AIR CIRCULATION PANEL

BACKGROUND OF THE INVENTION

1. Field of the Invention

This invention relates to a thermal control system employing an air circulation panel. More specifically, the invention relates to a device used to thermally control a room indirectly by circulating a temperature controlled fluid in a specially designed hollow chamber in a panel forming a portion of the room surface.

2. Description of the Related Art

There are several types of floor heating systems sometimes called radiant floor heating systems. One type disposes piping under a floor and then circulates a warm treated water in the piping, thereby warming the floor and thereafter the room. A second type disposes an electrical heater cable in the piping instead of warm water. These conventional systems may have installation or economic advantages, but their construction and maintenance is quite expensive. Further these conventional systems may have additional safety and maintenance risks.

Specifically, the warm treated water frequently contains ethylene glycol, a hazardous material when liquid. If the pipes leak, not only will the water cause severe structural damage, but the cleanup may be dangerous. Further, the water pipes are frequently encased in a liquid castable for support and to provide a flat floor. The use of such a castable is expensive and messy and prevents easy repair should the pipes leak and prevents use of this system on overhead or wall surfaces. Additionally, this type of conventional system is not used to cool and so is of limited use in changing residential climates.

Further, the electrical heater cable in piping may have an electrical short which is difficult to find and repair without removal of the entire pipe. The pipes holding the electrical heater cables are also frequently encased in a castable providing the same undesirable problems and risks stated above.

Applicant's have previously provided a simplified air circulation panel for cooling or heating a room. This simplified invention is disclosed in Applicant's Japanese patent application SN 11-348877.

In this apparatus a simplified air circulation panel employs a feeding pump to circulate warm or cool air into the interior of a panel on a room surface. The invention provide beneficial construction and maintenance costs compared with the above types but there were several undesirable disadvantages. One disadvantage was that heat conductivity of the structure was low and it took too much time to warm the floor or wall. A second disadvantage was that the expected cost savings were not realized since the operational time was extended. In sum, more improvements were required to reduce the energy costs and to ensure an easily maintained constant room temperature at low costs with easy construction and increased safety.

OBJECTS AND SUMMARY OF THE INVENTION

It is an object of the present invention to provide an air circulation panel that surmounts the forgoing undesirable properties.

It is another object of the present invention to provide an air circulation panel for a room which quickly circulates air in a piping apparatus along an interior surface of the room where the surface can be either a ceiling, floor, or wall.

It is another object of the present invention to provide an air circulation apparatus that may be easily integrated into floor, wall, or ceiling coverings.

It is another object of the present invention to provide an air circulation apparatus that easily maintains a constant temperature while reducing energy consumption.

It is another object of the present invention to provide an air circulation apparatus that reduces an environmental impact of the apparatus by reducing energy consumption and prevents the use of hazardous materials like ethylene glycol and minimizes fire risks from electrical failures.

Briefly stated, the present invention provides a thermal control system including an air colliding chamber bounded by at least a conducting board and an insulating panel. An air jet pipe and an air jet suction pipe extend into the air colliding chamber. Thermally adjusted air is urged into each air jet pipe, and out at least one air jet hole, into the air colliding chamber. In the air colliding chamber, air vortices repeatedly contact the conducting board and thermal transfer occurs. Return air is urged into each air suction pipe through at least one jet suction hole for return and thermal adjustment.

According to one embodiment of the present invention there is provided a thermal control apparatus, comprising: a conducting board, an insulating panel, an air colliding chamber bounded by at least the conducting board, and the insulating panel, at least one air supply pipe and at least one air return pipe in the air colliding chamber, the air supply pipe having at least a first air jet hole, the air return pipe having at least a first air jet suction hole, and first means for urging thermally adjusted air into the air supply pipe and out the at least first air jet hole effective to form a plurality of vortices within the air colliding chamber which causes a thermal exchange between the thermally adjusted air and the conducting board whereby the conducting board is changed in temperature.

According to another embodiment of the present invention there is provided a thermal control apparatus, wherein: the first means for urging includes a second means for urging return air into the at least one air jet suction hole and the air return pipe effective to promote the plurality of vortices whereby the thermal exchange is maximized and made more efficient.

According to another embodiment of the present invention there is provided a thermal control apparatus, further comprising: at least one supply pipe on the at least one air supply pipe distal the at least first air jet hole, the first means for urging includes a feeding pump on a proximate end of the supply pipe opposite the air supply pipe, at least one return pipe on the at least one air return pipe distal the at least first air jet suction hole, the second means for urging includes a suction pump on a proximate end of the supply pipe opposite the return pipe, and means for producing the thermally adjusted air joining the feeding pump and the suction pump effective to supply the thermally adjusted air to the feeding pump and accept the return air from the return pipe whereby thermal control of the conducting board is simplified.

According to another embodiment of the present invention there is provided a thermal control apparatus, further comprising: a plurality of air jet suction holes on a first end of the at least first air return pipe at a separation, in a direction, and at a position effective to maximize vortices thermal transfer to the conducting board, a plurality of air jet holes on a first end of the at least first air supply pipe at a separation, in a direction, and at a position effective to maximize vortices and thermal transfer to the conducting board, a first and a second side wall joining the conducting board and the insulating panel, and the first and the second side walls having a separation, at a height, and in a position effective to maximize the vortices in the air colliding chamber.

According to another embodiment of the present invention there is provided a thermal control apparatus, further comprising: at least a first and a second air colliding chambers connected in series along the conducting board, the air supply pipe and the air return pipe in each the chamber connecting in parallel to the supply pipe and the return pipe, and the conducting board extending on a first surface of each the air colliding chamber effective to maximize efficient thermal transfer from each the at least first and the second chamber.

According to another embodiment of the present invention there is provided a thermal control apparatus, wherein: the insulating panel includes a recess opposite each the air colliding chamber, and the recess having a shape and a position effective to receive and support the air supply pipe and the air return pipe and maximize efficient thermal transfer to the conducting board.

According to another embodiment of the present invention there is provided a thermal control apparatus, further comprising: at least a first by-pass wall in the air colliding chamber, the at least first by-pass wall having a shape and a position, and cantilevered from at least one of the conducting board and the insulating panel into the air colliding chamber, effective to maximize the air vortices and cause efficient thermal transfer to conducting board.

According to another embodiment of the present invention there is provided a thermal control apparatus, further comprising: at least a first reflective surface on at least one of a first inner surface of the insulating panel, a second inner surface of the recess, a third surface of the at least first by-pass wall, and a fourth inner surface of the first and the second side wall, and the at least first reflective surface having a thermal conductivity and a reflectivity spectrum effective to maximize effective thermal transfer to the conducting board.

According to another embodiment of the present invention there is provided a thermal control apparatus, further comprising: at least a first and a second base, the at least first and second bases adjacent the insulating panel and the conducting board, at least one the air colliding chamber between the first and second bases adjacent the conducting board, the at least first base on a first side of the insulating panel, and the at least second base on a second side of the insulating panel opposite the first base effective to support the conducting board resist a crushing force applied to the conducting board on a side opposite the air colliding chamber and preserve operation of the thermal control apparatus.

According to another embodiment of the present invention there is provided a thermal control apparatus, wherein: the insulating panel includes a recess opposite each the air colliding chamber, and the recess having a shape and a position effective to receive and support the air supply pipe and the air return pipe create the air colliding chamber to maximize efficient thermal transfer to the conducting board.

According to another embodiment of the present invention there is provided a thermal control apparatus, wherein: the air supply pipe on the air return pipe on a first side of the air colliding chamber.

According to another embodiment of the present invention there is provided a thermal control apparatus, further comprising: at least a first by-pass wall in the air colliding chamber, the at least first by-pass wall having a shape and a position, and cantilevered from at least one of the conducting board and the insulating panel into the air colliding chamber, effective to maximize the air vortices and cause efficient thermal transfer to conducting board.

According to another embodiment of the present invention there is provided a thermal control apparatus, further comprising: at least a first reflective surface on at least one of a first inner surface of the insulating panel, a second surface of the at least first by-pass wall, and the at least first reflective surface having a thermal conductivity and a reflectivity spectrum effective to maximize effective thermal transfer to the conducting board.

According to another embodiment of the present invention there is provided a thermal control apparatus, further comprising: a supply header, the supply header connecting to the supply pump to the at least one supply pipe having a shape and a position effective to equalize a supply pressure to the at least one supply pipe and increase the effective thermal transfer, a return header, the return header connecting the suction pump to the at least one return pipe having a shape and a position effective to equalize a suction pressure to the at least one supply pipe.

According to another embodiment of the present invention there is provided a thermal control apparatus, wherein: the means for producing includes an air chamber, an indoor device in thermal communication with an outdoor device through circulation of at least a cooling medium and effective to supply a thermally controlled air flow to the air chamber, the air chamber effective to operate a heat exchange between the thermally controlled air flow and the return air and produce the thermally adjusted air flow and supply the thermally adjusted air flow to the supply pump while receiving the return air from the return pipe.

According to another embodiment of the present invention there is provided a thermal control apparatus, comprising: an air colliding chamber defined by at least an insulating panel and a conducting board, a least a first air supply pipe having a first end shielded in the air colliding chamber, at least a first air return pipe having a second end shielded in the air colliding chamber, a feeding pump in communication with a third end of the air supply pipe, a suction pump in communication with a fourth end of the air return pipe, a boiler in communication with each the feeding pump and the suction pump, a plurality of air jet holes disposed adjacent the first end of the air supply pipe, a plurality of air jet suction holes disposed adjacent the second end of the first return pipe, and the feeding pump and the suction pump effective to urge a thermally adjusted air flow through the air supply pipe into the air colliding chamber and remove air through the air return pipe which causes multiple vortices which provide thermal exchange between the thermally adjusted air and the conducting board.

According to another embodiment of the present invention there is provided a thermal control apparatus, wherein: the air supply pipe is adjacent a first side of the air colliding chamber, and the air return pipe is adjacent a second side of the air colliding chamber opposite the air supply pipe.

According to another embodiment of the present invention there is provided a thermal control apparatus, wherein: the air supply pipe adjacent a first side of the air colliding chamber, and the air return pipe adjacent the air supply pipe.

According to another embodiment of said present invention there is provided a thermal control apparatus, further comprising: an air circulation unit, said air supply pipe and said air return pipe in said air circulation unit, said air circulation unit having a shape adapted to said insulating panel, said air colliding chamber in said air circulation unit, and said air circulation unit having a construction, a shape, and a material effective to provide efficient thermal transfer to said conducting board.

According to another embodiment of the present invention there is provided a thermal control apparatus, wherein: the plurality of air jet holes having a lateral position along a length direction of the air supply pipe, the plurality of air jet suction holes having a lateral position along a length of the air return pipe, each the air jet hole having a position intermediate each the air jet suction hole, and the plurality of air jet holes and the plurality of the air jet suction holes having a positions adjacent the air colliding chamber effective to maximize the air vortices and enhance efficient thermal transfer to the conducting board.

According to another embodiment of the present invention there is provided a thermal control apparatus, further comprising: at least a first by-pass wall, the at least one by-pass wall cantilevered from one of the conducting board and the insulating panel into the air colliding chamber, and the at least one by-pass wall effective to enhance the air vortices and enhance efficient thermal transfer to the conducting board.

According to another embodiment of the present invention there is provided a thermal control apparatus, further comprising: a surface plate on the conducting board, and the surface plate effective to receive thermal energy from the conducting board by conduction and transfer the thermal energy into an adjacent external region by one of convection and radiation whereby the thermal control device operates to thermally control the adjacent external region.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
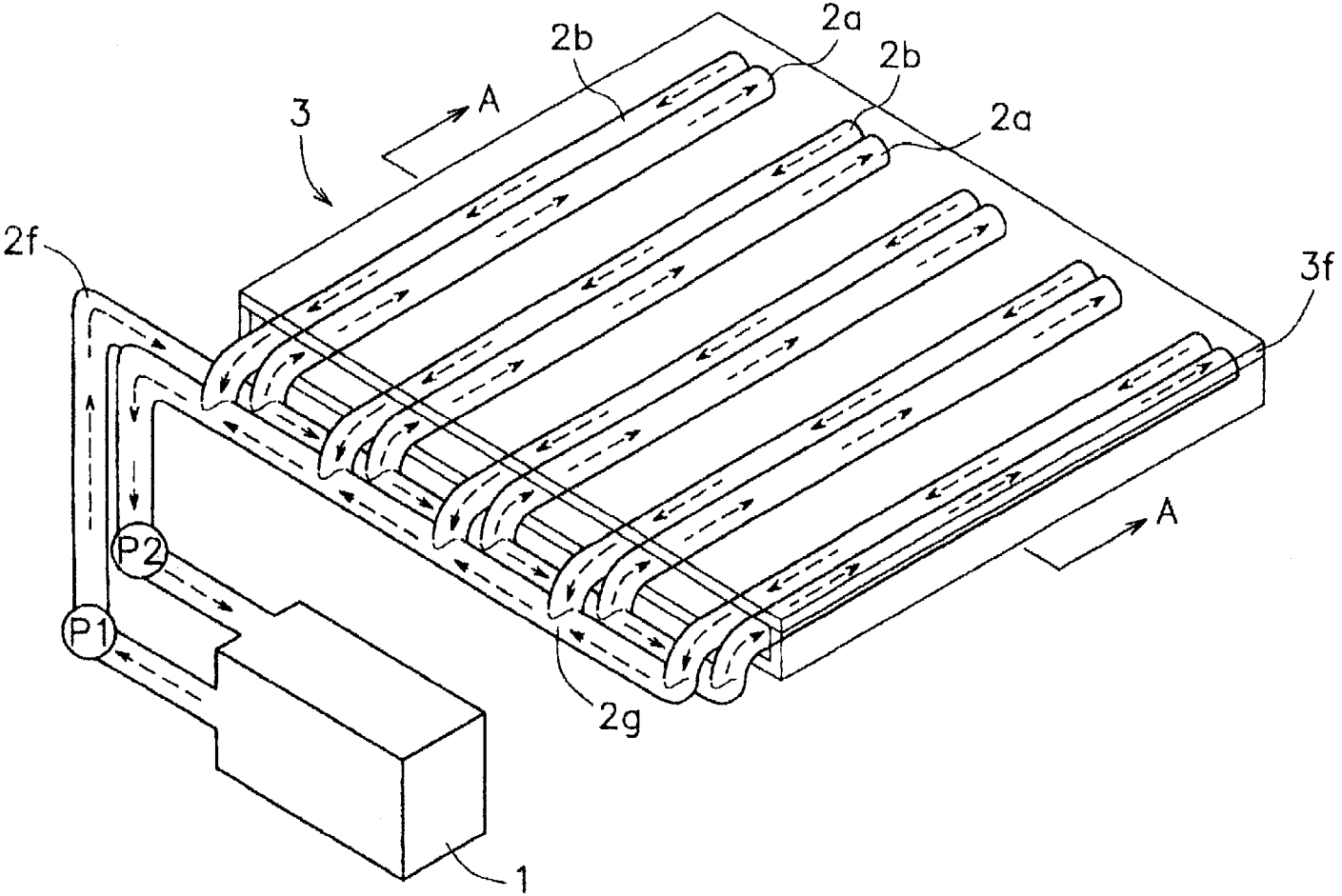
FIG. 1 is a perspective view of a system using a circulation panel.

Referring now to FIG. 1, during operation of the present invention, a circulating fluid (gas or liquid, air is used for convenience) is warmed to a desired temperature within a boiler 1 and fed into a supply pipe 2*f* by a supply pump P1. Supply pipe 2*f* distributes air into multiple air jet pipes 2*a* positioned below an air circulation panel 3. It is to be understood that the circulating gas may be air in common applications but may also include other gases selected to benefit the final application.

Air circulation board 3 includes a conducting board 3*f* positioned above air jet pipes 2*a*. Conducting board 3*f* is thermally adjusted (warmed or cooled) by the circulating gas. After heat conducting board 3*f* is warmed, air is suctioned through multiple air suction pipes 2*b* and into a return pipe 2*g* by return pump P2 for return to boiler 1. Upon return to boiler 1, the circulating gas is temperature adjusted and returned to supply pump P1.

Figure 2:
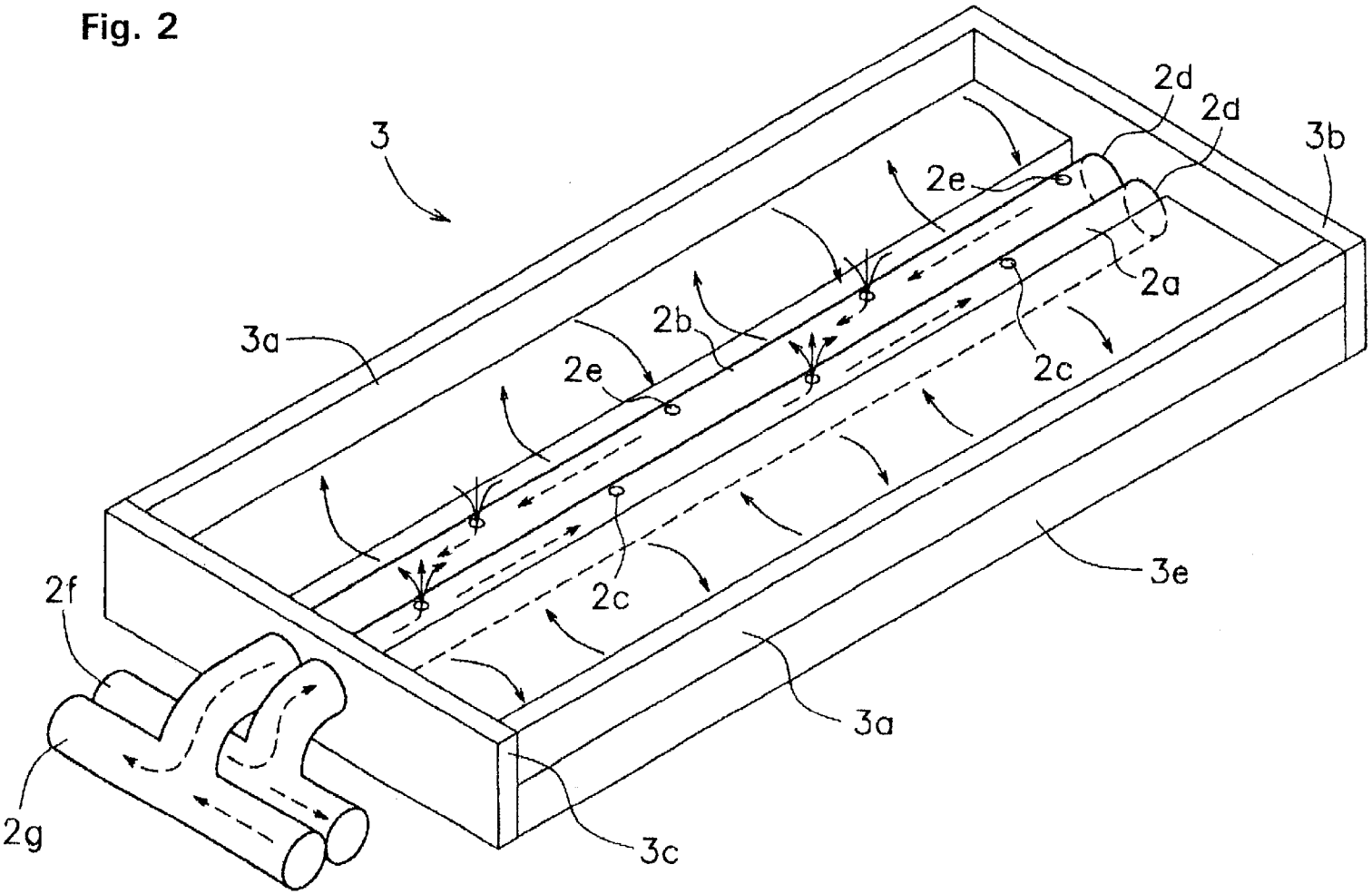
FIG. 2 is an enlarged exploded view of one compartment of a circulation panel.
Figure 3:
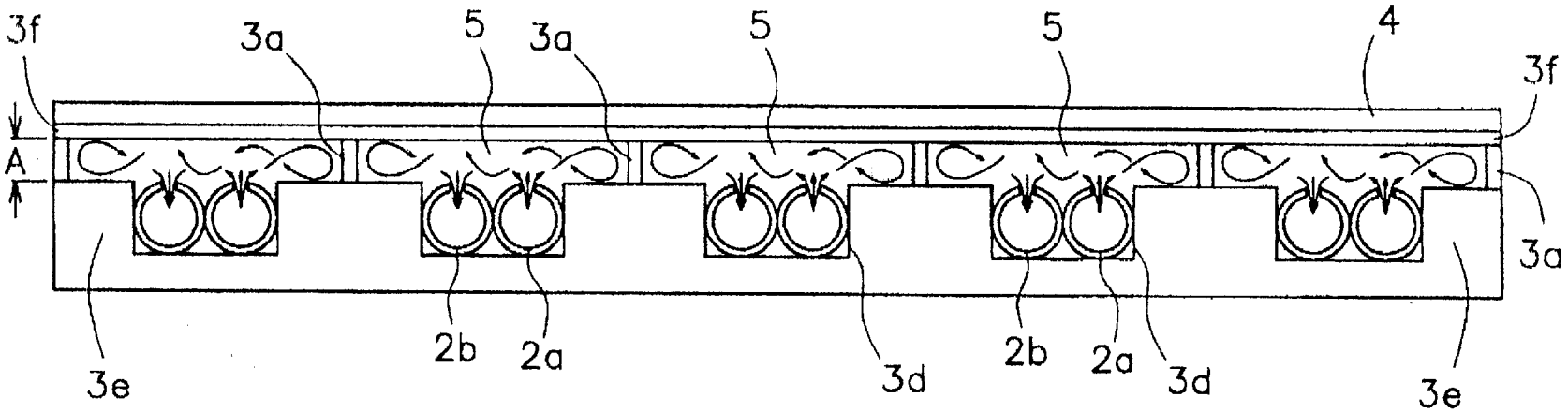
FIG. 3 is a section view taken along line A—A in FIG. 1.

Referring additionally now to FIGS. 2 and 3, air circulation panel 3 includes multiple air colliding chamber 5 partitioned by side walls 3*a*, and end walls 3*b*, 3*c*. Air colliding chamber 5 is bounded on a top side by conducting board 3*f* and on a bottom by an insulating panel 3*e*. Air colliding chamber has a defined height A. A floor plate 4 is mounted on an outside surface of conducting board 3*f*. It should be understood that floor plate 4 may be constructed to be on a wall or ceiling of a room and is called for convenience only a floor plate. Insulating panel 3*e* includes a recess 3*d* formed to retain each set of air jet pipes 2*a* and air suction pipes 2*b*. Alternative shapes for recess 3*d* may include individual sections for each pipe or variable surfaces to increase thermal transfer to conducting board 3*f*.

Air jet pipe 2*a* is part of supply pipe 2F. Multiple air jet holes 2*c* are perforated on an upper surface of each air jet pipe 2*a* with a desired spacing. An end 2*d* of each air jet pipe 2*a* is shielded.

Air suction pipe 2*b* is part of return pipe 2*g*. Multiple air jet suction holes 2*e* are perforated on an upper surface of each air suction pipe 2*b* with a desired spacing offset from air jet holes 2*c*.

During operation air is forced through air jet holes 2*c* into air colliding chamber 5 below conducting board 3*f* to create conflicting vortices within air colliding chamber 5. The air vortices allow the temperature of the air to be conducted to the inner surface of conducting board 3*f* by thermal convection and thereby to the outer surface of conducting board 3*f* and floor plate 4 by thermal conduction.

It is to be understood, that the position of air jet holes 2*c* on each air jet pipe 2*a* and the position of air jet suction holes 2*e* on each air suction pipe 2*b* is selected to maximize thermal transfer to conducting board 3*f*. It is to be understood, that since each air jet pipe 2*a* is capped by end 2*d*, any air forced into the respective pipes will escape through the corresponding holes under an increased speed due to the reduction in diameter at each hole. This increase in speed aids the creation of the conflicting vortices within each circulation chamber 5. It is to be further understood, that air jet holes 2*c* and air jet suction holes 2*e* may be made small, larger, or positioned differently about the radius of each respective air jet pipe 2*a* or air suction pipe 2*b* to maximize thermal transfer and rapid circulation.

It its to be further understood, that where air circulation panel 3 is placed on a surface of a room, the air within air colliding chambers 5 will have an additional convective force due to the gravity field of the earth. Where air circulation panel 3 is on a floor of the room, the convective forces are increased.

It is to be further understood, that the thermally conducting gas or air within the apparatus may be directed along nonlinear air jet pipes 2*a* or air suction pipes 2*b*. In other words, the shape, diameter, constructive material, wall thickness, and other factors of each air jet pipe 2*a* and air suction pipe 2*b* may be changed to maximize thermal transfer. Height A of air colliding chamber 5 may further be adjusted to maximize thermal transfer to conducting board 3*f*. Height A may be between a few millimeters (mm) to a few centimeters (cm) depending upon customer demand and thermal transfer needs.

It is to be understood, that it is known that the heat conducting capacity of the air in movement becomes several times to several ten time more than the air in a static condition. The present inventive apparatus employs the above-described unique construction to maximize thermal transfer from kinetic air movement.

During operation, air is fed continuously into air jet pipes 2*a* until supply pump P1 reaches a predetermined pressure, as a result, air is jetted vigorously from each air jet hole 2*c* and circulated to maximize thermal transfer. The position, shape, number, and size of air jet holes 2*c* and air jet suction holes 2*e* may be adjusted to maximize efficient thermal transfer. Since the air heated by boiler 1 repeatedly collides with conducting board 3*f*, the heat capacity transferred is dramatically increased.

Figure 4A:
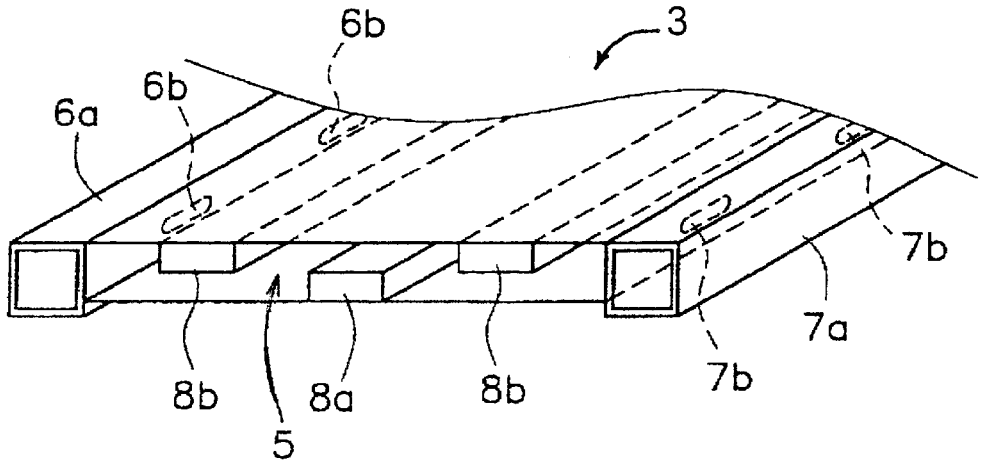
FIG. 4(A) is a view of a second embodiment of the air circulation panel.

Referring additionally now to FIG. 4(A) describing an additional embodiment of the present invention. In this embodiment, an air jet pipe 6*a*, which is part of a supply pipe (not shown) is disposed at a side or end of air circulation panel 3. An air suction pipe 7*a*, which is part of a return pipe (not shown) is disposed at an opposite side or end of air circulation panel 3.

Air jet pipe 6*a* and Air suction pipe 7*a* are facing each other in parallel on opposite sides of air colliding chamber 5. A plurality of air jet holes 6*b*, 6*b* are disposed on a side wall of air jet pipe 6*a*, and a plurality of air suction holes 7*b*, are disposed on a side wall of air suction pipe 7*a*.

A plurality of by-pass walls 8*a*, 8*b* are disposed with a predetermined spacing within air colliding air 5.

Figure 4B:
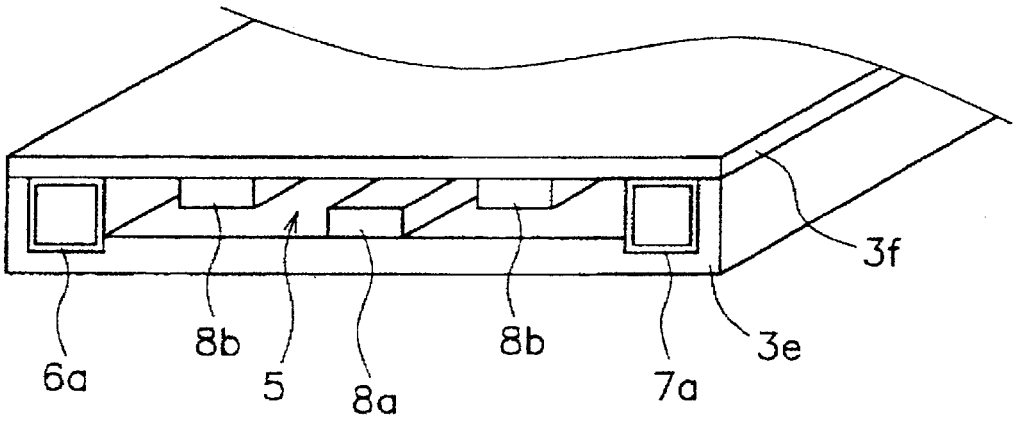
FIG. 4(B) is a view of the second embodiment of the air circulation panel.

Referring additionally now to FIG. 4(B) indicating an additional embodiment of the present invention. In this embodiment, insulating panel 3*e* includes separates recesses to contain respective air jet pipes 6*a* and respective air suction pipes 7*a*. Conducting board 3*f* contacts the top of both air jet pipe 6*a* and air suction pipe 7*a*, further increasing opportunities for improved thermal transfer.

Figure 5A:
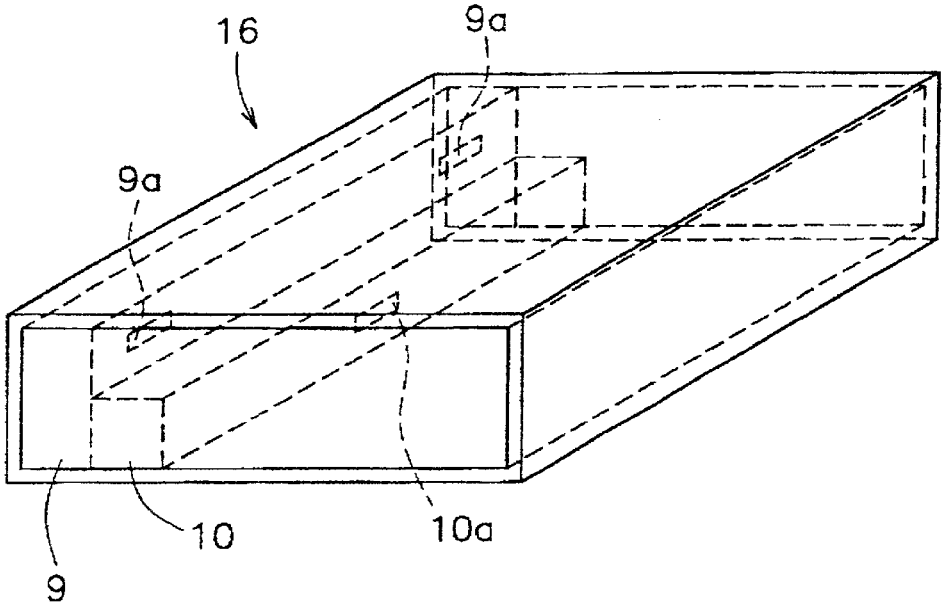
FIG. 5(A) is a view of a third embodiment of the circulation panel.
Figure 5B:
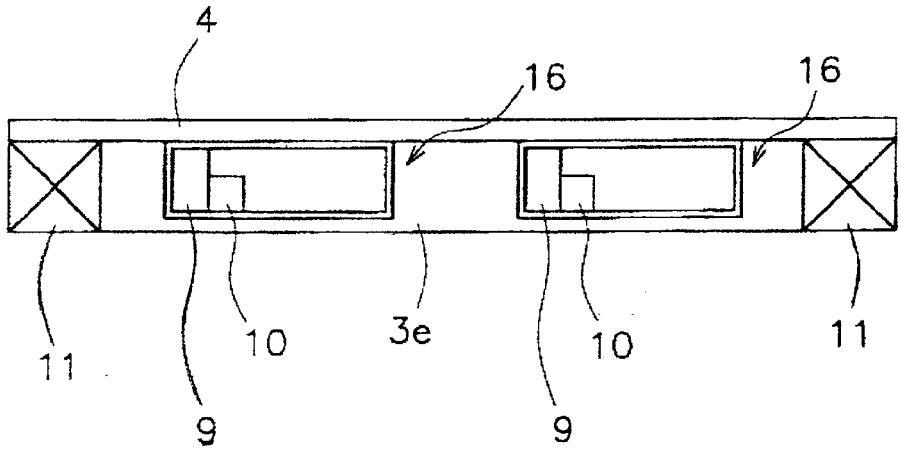
FIG. 5(B) is a view of the third embodiment of the circulation panel.

Referring additionally now to FIGS. 5(A) and 5(B) describing an additional embodiment of the present invention. In this embodiment, an air jet pipe 9 is part of an air supply pipe (not shown) and is at one side of an air circulation unit 16. A lower side of air jet pipe 9 contacts an air suction pipe 10. Air suction pipe 10 is part of a return pipe (not shown). At least one air jet hole 10*a* is on a center side of air suction pipe 10. Multiple air jet holes 9*a*, 9*a* are on air jet pipe 9 in the vicinity of two ends of air suction pipe 9.

Six sides of air circulation unit 16 are covered by an aluminum sheet or similar material having a function of rapid thermal conduction. If air circulation unit 16 is manufactured in advance, as shown in FIG. 5(B), insulation panel 3*e* would have recesses formed to receive air circulation unit 16. In this embodiment, at least two bases 11, are positioned on either side of multiple air circulation units 16. Each base 11 provides support for a conducting board 4 positioned above each air circulation unit 16. Since each air conduction unit 16 is thermally separate from the next air conduction unit, efficient thermal transfer occurs. Further, since each air circulation unit 16 may be manufactured as separate unit storage is simplified and process and assembly times are reduced.

Figure 6A:
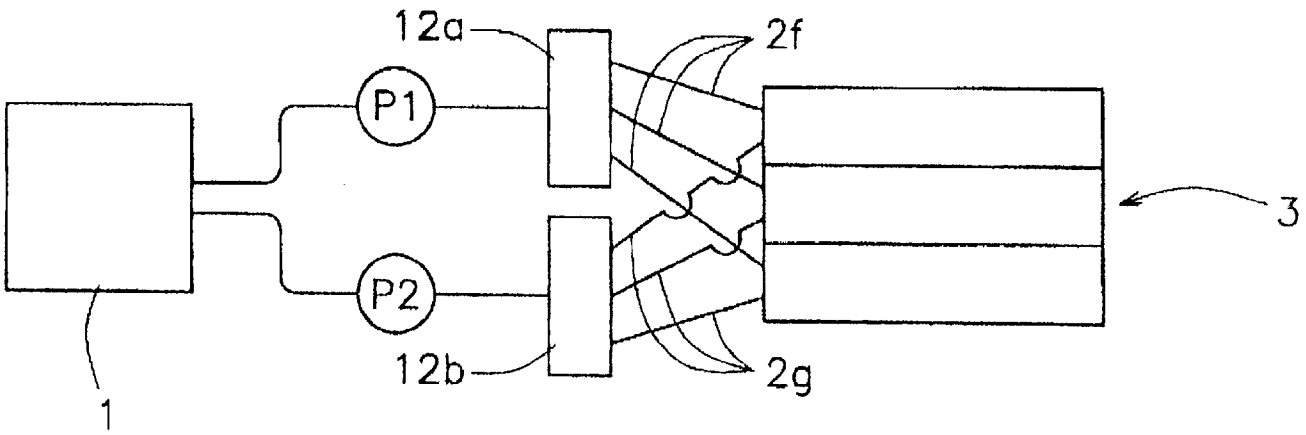
FIG. 6(A) is a view of one embodiment of a circulation system using a circulation panel according to the present invention.

Referring additionally now to FIG. 6(A), during operation of an embodiment of the present invention an air circulation route employing boiler 1 warms the air in air circulation panel 3. During operation of this embodiment, air is warmed by boiler 1 and is supplied to a header 12*a* by a feeding pump P1. Header 12*a* is positioned and has a shape to enable maintenance of uniform air pressure fed through supply pipes 2*f* to air circulation panel 3.

In this embodiment, air is fed to a plurality of air jet holes (not shown) in each compartment of air circulation panel 3 by way of header 12*a*. Upon return, air is urged into a plurality of air suction holes (not shown) in each air colliding chamber (not shown), through each return pipe 2*g* and into a header 12*b*, by return pump P2 for return to boiler 1.

Figure 6B:
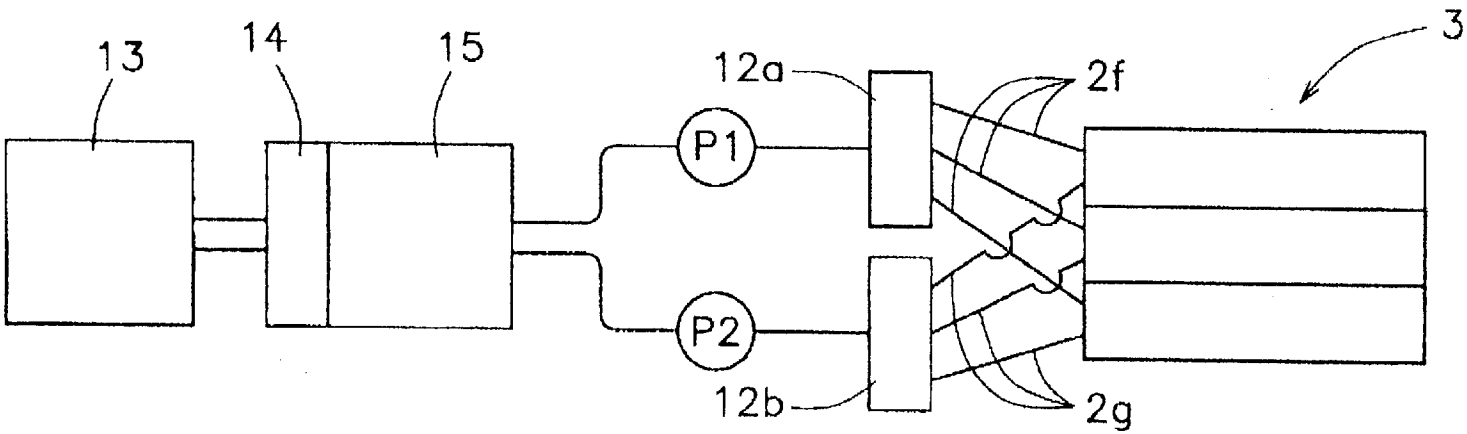
FIG. 6(B) is a view of an embodiment of an air circulation system using an apparatus of the present invention.

Referring additionally to FIG. 6(B), during operation of another embodiment of the present invention an air circulation rout employs an outdoor device 13 in communication with an indoor device 14. During operation, a thermal exchange is carried out by circulating a cooling medium between outdoor device 13 and indoor device 14. As a result, warmed or cooled air is supplied to an attached air chamber 15. Air chamber 15 includes a thermal exchange apparatus (not shown) to provide thermal control to the air supplied to header 12*a* by supply pump P1. The addition of air chamber 15 provides additional economic benefits through the thermal exchange and thermal recovery allowed by the novel design.

It should be understood, that various changes and modifications may be effected without departing from the spirit and scope of the present invention. Specifically, by-pass walls 8*a*, 8*b* may be additionally included in multiple shapes in either of the embodiments to encourage efficient thermal transfer. Further, by-pass walls 8*a*, 8*b* may have shapes adapted to promote rapid thermal transfer between the air vortices and conducting board 3*f*. It is also noted that by-pass walls 8*a*, 8*b* may be adapted to serve as thermal sinks to provide thermal momentum to conducting board 3*f* and further reduce operating costs, prevent sharp thermal gradients, and provide efficient thermal transfer.

Also, air circulation panels 3 may be arranged and connected in longitudinal or lateral directions according to customer and manufacture demand. Where required, ends 2*d* may be removed and additional air circulation panels 3 linked together to form a larger continuous air circulation panel 3.

It should be further understood, that according to the present invention inexpensive room thermal control may be enhanced using several commercially marketed controllable boilers 1 thereby increasing adaptability of the present invention and lowering costs.

It should be further understood that the present invention is able to carry out an inexpensive room cooling/heating system by using a cool or warm air discharged from an indoor device of an air conditioner.

Further, the thermally adjusted gas or air in air colliding chamber 5 of air circulation panel 3 is collided many times against conducting board 3*f* so that rapid thermal exchange is promoted. Consequently, the air can reach a floor surface, a vertical wall surface, or a horizontal ceiling surface in a short time so that it is available to keep the room at a preferred temperature while saving power consumption. Using adaptive supply pipes 2*f* and return pipes 2*g*, a single boiler 1 may be adapted to service multiple air circulation panels 3 on a ceiling, wall, or floor or any combination of these three. This easy adaptability allows ready adaption to a variety of unusual structural situations either residential or commercial.

Additionally, the present invention allows uniform circulation over conducting board 3*f* which in turn allows the room air temperature to remain constant while reducing operating costs. In sum, the present invention allows a gentile thermal changes to occur in a room. This gentile thermal change is of particular benefit when compared to other thermal systems blowing warm or cold air and creating undesirable sharp thermal gradients.

The above embodiments of the present invention also allow simplified manufacturing and assembly further reducing consumer costs, maintenance costs, and safety risks.

Specifically, the present invention allows for minor system failures such as pin-hole leaks or partial blockage in flow while maintaining overall efficiency, whereas liquid systems cannot tolerate leaks, and electrical system shorts increase fire risk and equipment damage. Specifically, where blockage of a single air jet hole 2*c* or single air suction hole 2*e* occurs, or where either of air jet pipes 2*a* or air suction pipes 2*b* have a small leak, the remaining system can still function efficiently and effectively. Since each air colliding chamber 5 includes a separate mini-system (i.e. separate supply and return pipes), even if an entire individual chamber fails, the entire system compensates for such failure and continues to operate effectively. This provides substantial benefit over the other types of systems available.

It should be further understood, that an inside surface of insulating panel 3*e* may be coated with a thermally reflective material to increase effective thermal transfer to conducting board 3*f*.

It should be understood, that the above-described circulation gas or air may be any gas capable of carrying out thermal transfer to conducting board 3*f* when joined to a suitable boiler 1. i.e. boiler 1 may serve either or both the function increasing and decreasing the thermal energy of the air. For example, carbon monoxide or dioxide may be cooled to very low temperatures and allow conducting board 3*f* to operate in a refrigeration environment. As a further example, argon or nitrogen may be heated to a very high temperature to allow conducting board 3*f* to operate in an oven or low-temperature furnace environment while limiting the possibility of fire and equipment degradation through elimination of oxygen.

It should be understood, that the above-described circulation gas or air are merely examples of a fluid capable of thermal transfer and this fluid, as defined, may be either a gas (such as air above), or a liquid (such as water).

It should be understood, that multiple air colliding chambers may be assembled in series or parallel (or at angles to each other) to thermally control a surface adjacent the air colliding chamber.

It should be understood, that air jet pipes 2*a* and air suction pipes 2*b* may be non-linear or have repeating indentations or other non-common shapes to direct air flow, maximize air vortices, and increase efficient thermal transfer to conducting board 3*f*.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described or suggested herein as performing the recited function and not only structural equivalents but also equivalent structures. Thus, although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A thermal control apparatus, comprising:

a conducting board;

an insulating panel;

a colliding chamber bounded by at least said conducting board, and said insulating panel;

at least one fluid supply pipe and at least one fluid return pipe in said colliding chamber;

said fluid supply pipe having at least a first fluid jet hole;

said fluid return pipe having at least a first fluid jet suction hole;

first means for urging a thermally adjusted fluid into said fluid supply pipe and out said at least first fluid jet hole effective to form a plurality of vortices within said colliding chamber which enhances a thermal exchange between said thermally adjusted fluid and said conducting board whereby a temperature control of said conducting board is maintained said first means for urging includes a second means for urging return fluid into said at least one fluid jet suction hole and said fluid return pipe effective to promote said plurality of vortices whereby said thermal exchange is maximized and made more efficient;

at least one supply pipe on said at least one fluid supply pipe distal said at least first fluid jet hole;

said first means for urging includes a feeding pump on a proximate end of said supply pipe opposite said fluid supply pipe;

at least one return pipe on said at least one fluid return pipe distal said at least first fluid jet suction hole;

said second means for urging includes a suction pump on a proximate end of said supply pipe opposite said return pipe; and means for producing said thermally adjusted fluid joining said feeding pump and said suction pump effective to supply said thermally adjusted fluid to said feeding pump and accept said return fluid from said return pipe whereby thermal control of said conducting board is simplified.

2. A thermal control apparatus, according to claim 1, further comprising:

a plurality of fluid jet suction holes on a first end of said at least first fluid return pipe at a separation, in a direction, and at a position effective to maximize vortices thermal transfer to said conducting board;

a plurality of fluid jet holes on a first end of said at least first fluid supply pipe at a separation, in a direction, and at a position effective to maximize vortices and thermal transfer to said conducting board;

a first and a second side wall joining said conducting board and said insulating panel; and said first and said second side walls having a separation, at a height, and in a position effective to maximize said vortices in said colliding chamber.

3. A thermal control apparatus, according to claim 2, further comprising:

at least a first and a second colliding chamber connected in series along said conducting board;

said fluid supply pipe and said fluid return pipe in each said chamber connecting in parallel to said supply pipe and said return pipe; and said conducting board extending on a first surface of each said colliding chamber effective to maximize efficient thermal transfer from each said at least first and said second chamber.

4. A thermal control apparatus, according to claim 1, wherein:

said thermally controlled fluid is a gas.

5. A thermal control apparatus, according to claim 1, wherein:

said thermally controlled fluid is a liquid.

6. A thermal control apparatus, comprising:

a colliding chamber defined by at least an insulating panel and a conducting board;

a least a first fluid supply pipe having a first end shielded in said fluid colliding chamber;

at least a first fluid return pipe having a second end shielded in said fluid colliding chamber;

a feeding pump in communication with a third end of said fluid supply pipe;

a suction pump in communication with a fourth end of said fluid return pipe;

a boiler in communication with each said feeding pump and said suction pump;

a plurality of fluid jet holes disposed adjacent said first end of said fluid supply pipe;

a plurality of fluid jet suction holes disposed adjacent said second end of said first return pipe; and said feeding pump and said suction pump effective to urge a thermally adjusted fluid flow through said fluid supply pipe into said colliding chamber and remove fluid through said fluid return pipe which causes multiple vortices which provide thermal exchange between said thermally adjusted fluid and said conducting board.

7. A thermal control device, according to claim 6, wherein:

said fluid supply pipe adjacent a first side of said colliding chamber; and said fluid return pipe adjacent said fluid supply pipe.

8. A thermal control device, according to claim 6, wherein:

said plurality of fluid jet holes having a lateral position along a length direction of said fluid supply pipe;

said plurality of fluid jet suction holes having a lateral position along a length of said fluid return pipe;

each said fluid jet hole having a position intermediate each said fluid jet suction hole; and said plurality of fluid jet holes and said plurality of said fluid jet suction holes having a positions adjacent said colliding chamber effective to maximize said vortices and enhance efficient thermal transfer to said conducting board.

9. A thermal control device, according to claim 6, further comprising:

an fluid circulation unit;

said fluid supply pipe and said fluid return pipe in said fluid circulation unit;

said fluid circulation unit having a shape adapted to said insulating panel;

said colliding chamber in said fluid circulation unit; and said fluid circulation unit having a construction, a shape, and a material effective to provide efficient thermal transfer to said conducting board.

10. A thermal control device, according to claim 9, further comprising:

a surface plate on said conducting board; and said surface plate effective to receive thermal energy from said conducting board by conduction and transfer said thermal energy into an adjacent external region by one of convection and radiation whereby said thermal control device operates to thermally control said adjacent external region.

* * * * *